US010384845B2

(12) United States Patent
Earley

(10) Patent No.: US 10,384,845 B2
(45) Date of Patent: Aug. 20, 2019

(54) SELF SEALING INDUSTRIAL WRAPPING MEDIUM

(71) Applicant: MetPro Ltd, Tralee, County Kerry (IE)

(72) Inventor: Rick Earley, Tralee (IR)

(73) Assignee: MetPro Ltd, Tralee, County Kerry (IE)

( * ) Notice: Subject to any disclaimer, the term of this patent is extended or adjusted under 35 U.S.C. 154(b) by 274 days.

(21) Appl. No.: 15/118,514

(22) PCT Filed: Feb. 12, 2015

(86) PCT No.: PCT/EP2015/053014
§ 371 (c)(1),
(2) Date: Aug. 12, 2016

(87) PCT Pub. No.: WO2015/121375
PCT Pub. Date: Aug. 20, 2015

(65) Prior Publication Data

US 2017/0050788 A1 Feb. 23, 2017

(30) Foreign Application Priority Data

Feb. 12, 2014 (IE) ..... S2014/0040

(51) Int. Cl.
*B32B 3/10* (2006.01)
*B65D 65/02* (2006.01)
(Continued)

(52) U.S. Cl.
CPC ..... *B65D 65/02* (2013.01); *B65D 65/14* (2013.01); *B65D 85/04* (2013.01); *B65D 85/66* (2013.01)

(58) Field of Classification Search
None
See application file for complete search history.

(56) References Cited

U.S. PATENT DOCUMENTS 5,302,428 A * 4/1994 Steele ..... B29C 61/0616 138/128
5,861,201 A * 1/1999 Blackwelder ..... B32B 5/18 101/483
2009/0140202 A1* 6/2009 Takahashi ..... C09D 5/086 252/188.28

FOREIGN PATENT DOCUMENTS

GB 2 349 128 A 10/2000
WO 1995/012528 A2 5/1995
(Continued)

OTHER PUBLICATIONS

International Search Report for corresponding International Application No. PCT/EP2015/053014 dated Apr. 16, 2015.
(Continued)

*Primary Examiner* — Christopher M Polley
(74) *Attorney, Agent, or Firm* — Howard & Howard Attorneys PLLC

(57) ABSTRACT

The present invention relates to a protective wrapping medium, for particular application to large rolls of metal sheeting by automatic wrapping machines, for example as used within the steel and aluminum sectors, that is designed to provide both protection against physical damage which may occur during transport and/or storage, in addition to protection against chemical corrosion, while permitting printed branding to be incorporated into the wrapping medium if desired, the wrapping medium having a substrate with opposed first and second surfaces, with a first layer of cohesive material (22) applied as a substantially longitudinally extending band on the first surface adjacent a first edge of the substrate, and a second layer of cohesive material (24) applied as a substantially longitudinally extending band on the second surface adjacent a second edge of the substrate.

13 Claims, 3 Drawing Sheets

(51) Int. Cl.

| | |
|---|---|
| ***B65D 65/14*** | (2006.01) |
| ***B65D 85/04*** | (2006.01) |
| *B65D 85/66* | (2006.01) |

(56) References Cited

FOREIGN PATENT DOCUMENTS

| | | | | |
|---|---|---|---|---|
| WO | WO9512528 | A1 | * | 5/1995 |
| WO | 2006/136002 | A1 | | 12/2006 |

OTHER PUBLICATIONS

Written Opinion of the International Searching Authority for corresponding International Application No. PCT/EP2015/053014 dated Apr. 16, 2015.

* cited by examiner

SELF SEALING INDUSTRIAL WRAPPING MEDIUM

This application is a national phase of International Application No. PCT/EP2015/053014 filed Feb. 12, 2015 and published in the English language, which claims priority to Application No. IE S2014/0040 filed Feb. 12, 2014, all of which are hereby incorporated by reference.

FIELD OF THE INVENTION

This invention relates to an industrial wrapping medium for use in automatic wrapping within the metals sector such as steel and aluminium that is designed to provide both protection against physical damage which may occur during transport and/or storage, in addition to protection against chemical corrosion, while permitting printed branding to be incorporated into the wrapping medium if desired.

BACKGROUND OF THE INVENTION

Historically within various industries, for example the steel industry, various forms of packaging mediums and materials have been used for the wrapping of commercial or industrial products such as steel strip coils with commodity products such as stretch film in either a single substrate or multiple substrates dependent upon the level of protective packaging required.

In respect of automatic wrapping, machines and more specifically the carriage that drives the material carousel were designed to apply a stretch film grade that had vapour corrosion inhibitors (VCI) extruded within the film of 20 mu-50 mu with an overlap of 50-70% of the width of the film. Performance of this product type was very poor as protective levels were low with the robust handling and logistics encountered in the internal/external transport and storage of such steel coils.

When additional protection was required wrapping machines were built with a dual carriage system that applied two wrapping mediums to the product. The first layer generally consisted of a paper or plastic type material that afforded additional strength protection, which layer was then enclosed with a second layer of a stretch type film.

In the aluminium sector again automatic wrapping machines were designed to use a stretch film grade to protect aluminium profiles and sections. Generally the stretch film specification was between 25 mu-40 mu. Again issues were encountered with the film product not providing adequate protection to the aluminium profiles against damage due to handling, storage and transportation.

One of the key factors leading to damage to the product is a tendency, in storage, for the protective film to tear and split due to the tacky nature of the protective film, which when contacting another wrapped product would adhere to wrapping of that product.

SUMMARY OF THE INVENTION

According to a first aspect of the present invention there is provided a protective wrapping medium comprising a substrate having opposed first and second surfaces; a first layer of cohesive material applied as a substantially longitudinally extending band on the first surface adjacent a first edge of the substrate; and a second layer of cohesive material applied as a substantially longitudinally extending band on the second surface adjacent a second edge of the substrate.

Preferably, the first and/or second layer of cohesive material extend across between 5% and 95% of the width of the substrate from the respective edge, more preferably between 20% and 50% of the width, and most preferably approximately 33% of the width from the respective edge.

Preferably, the wrapping medium comprises a first layer of non adhesive material applied as a substantially longitudinally extending band on the first surface adjacent a second edge of the substrate.

Preferably, the wrapping medium comprises a second layer of non adhesive material applied as a substantially longitudinally extending band on the second surface adjacent a first edge of the substrate.

Preferably, the first and/or second layer of non adhesive material extend across between 5% and 95% of the width of the substrate from the respective edge, more preferably between 20% and 50% of the width, and most preferably approximately 33% of the width from the respective edge.

Preferably, the wrapping medium comprises a corrosion inhibitor provided as a substantially longitudinally extending band on the first surface adjacent the second edge of the substrate and underlying the second layer of cohesive material.

Preferably, the corrosion inhibitor extends across between 5% and 95% of the width of the substrate from the respective edge, more preferably between 40% and 80% of the width, and most preferably approximately 66% of the width from the respective edge.

Preferably, the corrosion inhibitor is a vapour corrosion inhibitor.

Preferably, the corrosion inhibitor is comprised in a surface coating applied to the substrate.

Preferably, the substrate is printed on, in an area between the first layer of non adhesive material and the second layer of cohesive material, on the second surface.

Preferably, the wrapping medium comprises a layer of lacquer overlying at least the printed area of the second surface.

Preferably, the substrate comprises one or more surface treatments.

Preferably, the wrapping medium comprises one or more adhesion promoters applied to the substrate.

Preferably, the substrate comprises a polymer chosen from HDPE, LDPE or PE weave type materials.

BRIEF DESCRIPTION OF THE DRAWINGS

The present invention will now be described with reference to the accompanying drawings, in which.

DETAILED DESCRIPTION OF THE INVENTION

Referring now to the accompanying drawings there is illustrated an industrial wrapping medium, generally indicated at 10, for use in wrapping any suitable product in order to provide a protective skin or layer around the product. The wrapping medium 10 is particularly intended for use with industrial products such as steel or aluminium components, for example steel coils, Rod Coils, Steel Sheets, Architectural Profiles, etc. The wrapping medium 10 has been designed, as will be described in greater detail hereinafter, to provide both protection against physical damage which may occur primarily during transport and/or storage, and corrosion protection through the incorporation of a vapour corrosion inhibitor carried by or on the wrapping medium 10, again as will be described in detail hereinafter.

Figure 1:
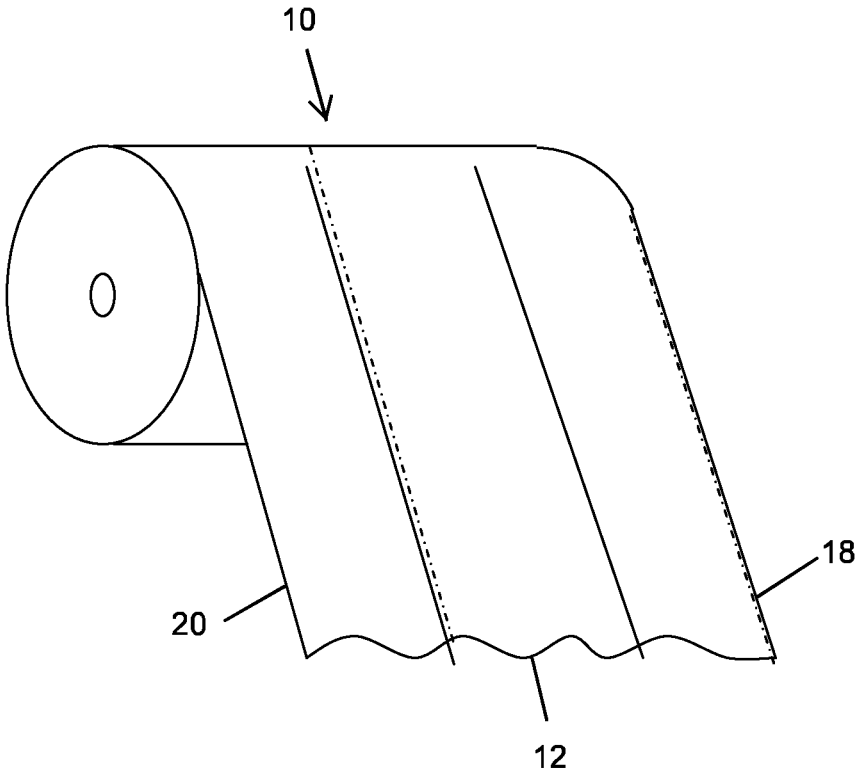
FIG. 1 illustrates a perspective schematic representation of a spool of a protective wrapping medium according to an embodiment of the present invention.
Figure 2:
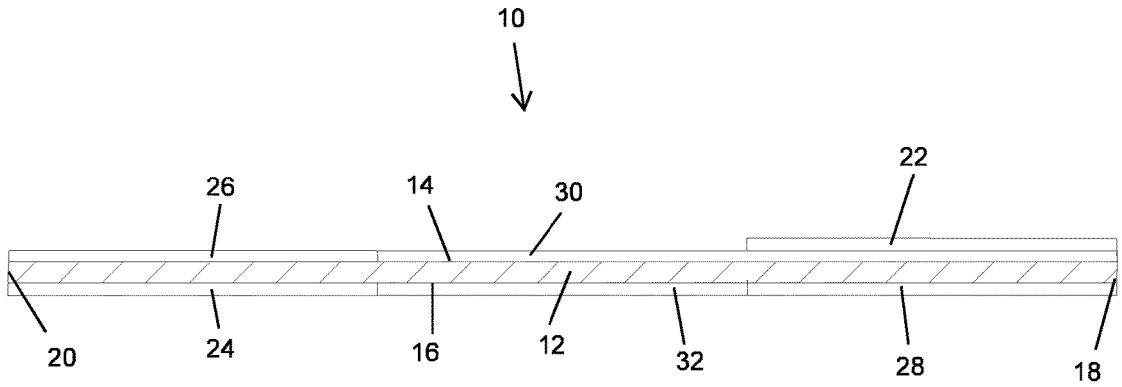
FIG. 2 illustrates a sectioned schematic representation of the protective wrapping illustrated in FIG. 1.

The wrapping medium 10 comprises a substrate 12 which may be of any suitable material, and for example may be a paper type material such as a crepe paper product or a polymer product such as high density polyethylene (HDPE) film, low density polyethylene (LDPE) film or polyethylene (PE) weave type material. This substrate 12 forms the core of the wrapping medium 10 and provides significantly improved strength and tear resistance over more conventional stretch film type products used in the steel and aluminium industry as protective wrapping. In most cases, for practical purposes and to allow the wrapping medium 10 to be dispensed from an automatic wrapping machine (not shown) or the like, the wrapping medium 10 is provided in elongate strip like form which can then be wound onto a spool as illustrated in FIG. 1. The wrapping medium 10 can then be considered to have a longitudinal dimension which extends in parallel to the direction in which the wrapping medium 10 is wound onto or off the spool, and a width dimension which extends transverse to the longitudinal dimension.

In use the wrapping medium 10 is wrapped around a product (not shown), and the substrate 12 can therefore be considered to have a first or outer surface 14 faces outwardly away from product, and an opposed second or inner surface 16 which will initially lie directly against or facing the product, and as layers of the wrapping medium 10 overlap one another during the wrapping process, will also partially overlie the first surface 14 of the previous layer. The substrate 12 additionally comprises a first longitudinal edge 18 and a second longitudinal edge 20 between the width of the substrate 12 is defined.

Carried by the substrate 12 on the first surface 14 is a first band 22 of a cohesive, also commonly knows as a cold seal, for example an acrylate based composition, which preferably extends continuously in a longitudinal direction along the substrate 12. The first band 22 extends width ways from at or adjacent to the first longitudinal edge 18 a distance approximately one third of the width of the substrate 12, although it will appreciated from the following description that this dimension may be varied significantly depending on the desired overlap between adjacent layers of the wrapping medium 10 on a wrapped product and/or the desired degree of cohesion between said adjacent layers. This first band 22 is provided on the first surface 14 and may be applied by any suitable means, for example through spraying or coating in liquid form.

Similarly the substrate 12 carries a second band 24 of cohesive, but on the opposed second surface 16 and adjacent the second longitudinal edge 20, preferably extending substantially continuously in the longitudinal direction and across approximately one third of the width of the substrate 12.

The wrapping medium 10 additionally comprises a first strip 26 of non adhesive material, also commonly knows as a release agent or anti blocking lacquer, extending substantially continuously in the longitudinal direction and on the first surface 14 for resistance, from the second longitudinal edge 20, approximately one third of the width of the substrate 12. This first strip 26 of non adhesive or anti block lacquer, for example a propanol based composition, thus essentially mirrors the second band 24 of cohesive material, such that when the laminate 10 is wound onto a spool with adjacent layers fully overlapping or overlying one another, the second band 24 of cohesive material will come into that adjacent layers of the wrapping medium 10 do not adhere to one another in the area of the second band 24.

Similarly the wrapping medium 10 is provided with a second strip 28 of non adhesive or anti block lacquer on the second surface 16 and extending from the first longitudinal edge 18 approximately one third the distance across the width of the wrapping medium 10. Again this second strip 28 essentially mirrors the first band 22 of cohesive material, such that when the wrapping medium 10 is wound onto a spool, adjacent layers will not adhere to one another in the region of the first band 22 of cohesive material. It will of course be appreciated that where the dimensions of the first band 22 and/or the second band 24 are varied, the corresponding dimensions of the first strip 26 and/or the second strip 28 should be varied accordingly.

The wrapping medium 10 additionally comprises a layer or coating 30 of a carrier material, for example a propanol-acetate based composition, containing a vapour corrosion inhibitor, for example a water based volatile corrosion inhibiting mixture consisting of a blend of primary amines and organic fatty acids, preservatives & chelating agents. The coating 30 is preferably provided substantially continuously along the substrate 12 in the longitudinal direction and extends from the first longitudinal edge 18 across approximately two thirds of the width of the substrate 12 in the embodiment illustrated. This dimension may be varied as required but should be dimensioned such that when a product is wrapped with multiple partially overlapping layers of the laminate 10 substantially the entire surface area of the product is covered by at least one layer of the coating 30 incorporating the corrosion inhibitor, ensuring that no portion of the product is exposed or uncovered by an absence of the coating 30.

A portion of the wrapping medium 10, for example the central region of the second surface 16 between the second band 24 and the second strip 28, may be surface treated such as to accept printing thereon, in order to, for example, allow a logo or other printed matter to be applied to the substrate 12. This printed region may then be covered with an overlying lacquer 32 in order to protect the printed region. This printed matter will then be visible on the wrapped product through the preferably transparent substrate 12.

Turning then to the application of the wrapping medium 10 to a product to be protected, and as mentioned above the wrapping medium 10 is preferably wound onto a spool which may be loaded on an automatic wrapping machine (not shown) of substantially conventional design and operation. Such automatic wrapping machines will generally include some form of carriage or the like in order to secure and retain a product to be wrapped. The carriage can then be rotated once the free end of the wrapping medium 10 is fixed to the product, in order to draw the wrapping medium 10 off the spool and around the product as it is rotated.

Figure 3:
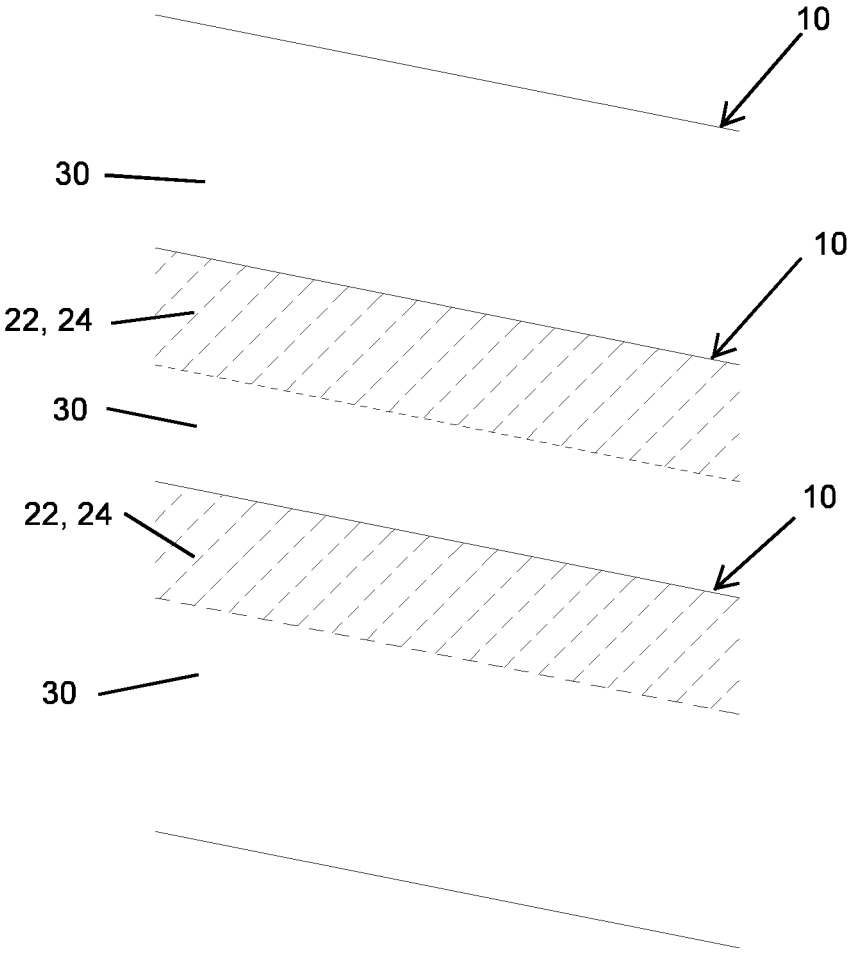
FIG. 3 illustrates a schematic representation of multiple partially overlapping layers of the wrapping laminate illustrated in FIG. 1.

As the product is rotated the spool of wrapping medium 10, or the product, is simultaneous moved in a direction transverse to the longitudinal or dispensing direction of the wrapping medium 10, and at a rate relative to rotation of the product such that adjacent layers of the wrapping medium 10 applied to the product will be partially overlapped such that only a portion of adjacent layers overlap one another. In the present embodiment adjacent layers of the wrapping medium 10 are intended to be overlapped by one third of the width of the wrapping medium 10, which corresponds to the width of both the first band 22 and the second band 24 of cohesive. In this way the first and second bands 22, 24 will be substantially fully overlapped with one another between immediately adjacent overlapping layers of the wrapping medium 10, as illustrated for example in FIG. 3, in which the overlapped and contacting first and second bands 22, 24 are shown in hatched detail. The cohesive of the first and second bands 22, 24 will thus adhere to one another in order to retain the wrapping medium 10 in position around the wrapped product. It can also be seen from FIG. 3 that by overlapping adjacent layers of the wrapping medium 10 in this manner that the area of the wrapping medium 10 incorporating the coating 30 of one layer will be in edge to edge alignment with the coating 30 of the immediately adjacent layer, thereby ensuring that there is a continuous coverage of the coating 30 across multiple staggered or offset layers of the wrapping medium 10.

The present invention therefore provides a protective wrapping medium 10 that provides superior mechanical strength and damage protection, corrosion protection, which additionally allow the wrapping medium 10 to carry printed matter thereon.

The invention claimed is:

1. A protective wrapping medium comprising a substrate having opposed first and second surfaces; a first layer of cohesive material applied as a substantially longitudinally extending band on the first surface adjacent a first edge of the substrate; a second layer of cohesive material applied as a substantially longitudinally extending band on the second surface adjacent a second edge of the substrate; and a corrosion inhibitor provided as a substantially longitudinally extending band on the first surface adjacent the second edge of the substrate and underlying the second layer of cohesive material.

2. A protective wrapping medium according to claim 1 in which the first and/or second layer of cohesive material extend across between 5% and 95% of the width of the substrate from the respective edge.

3. A protective wrapping medium according to claim 1 comprising a first layer of non adhesive material applied as a substantially longitudinally extending band on the first surface adjacent a second edge of the substrate.

4. A protective wrapping medium according to claim 3 comprising a second layer of non adhesive material applied as a substantially longitudinally extending band on the second surface adjacent a first edge of the substrate.

5. A protective wrapping medium according to claim 4 in which the first and/or second layer of non adhesive material extend across between 5% and 95% of the width of the substrate from the respective edge.

6. A protective wrapping medium according to claim 1 in which the corrosion inhibitor extends across between 5% and 95% of the width of the substrate from the respective edge.

7. A protective wrapping medium according to claim 1 in which the corrosion inhibitor comprises a vapour corrosion inhibitor.

8. A protective wrapping medium according to claim 1 in which the corrosion inhibitor is comprised in a surface coating applied to the substrate.

9. A protective wrapping medium according to claim 3 in which the substrate is printed on, in an area between the first layer of non adhesive material and the second layer of cohesive material, on the second surface.

10. A protective wrapping medium according to claim 9 comprising a layer of lacquer overlying at least the printed area of the second surface.

11. A protective wrapping medium according to claim 1 in which the substrate comprises one or more surface treatments.

12. A protective wrapping medium according to claim 1 comprising one or more adhesion promoters applied to the substrate.

13. A protective wrapping medium according to claim 1 in which the substrate comprises a polymer chosen from HDPE, LDPE or PE weave type materials.

* * * * *